United States Patent [19]

Martino

[11] 3,971,206

[45] July 27, 1976

[54] DISTRIBUTED WATCH

[75] Inventor: Raymond R. Martino, Sharon Hill, Pa.

[73] Assignee: U.S. Electronic Services Corporation, Sharon Hill, Pa.

[22] Filed: Oct. 3, 1974

[21] Appl. No.: 511,593

[52] U.S. Cl. ..... 58/88 R; 58/23 BA; 224/4 R

[51] Int. Cl.[2] ..... G04B 37/00; G04C 3/00

[58] Field of Search ..... 58/23 BA, 53, 55, 88 R, 58/88 W; 224/4 R, 4 A, 4 D

[56] References Cited

UNITED STATES PATENTS

| | | | |
|---|---|---|---|
| 2,665,542 | 1/1954 | Sheldon | 58/23 BA |
| 3,032,651 | 5/1962 | Stahli et al. | 58/23 BA |
| 3,492,809 | 2/1970 | Gisigerlusa | 58/88 R |
| 3,597,913 | 8/1971 | Fujimori | 58/23 BA |
| 3,788,059 | 1/1974 | Spadini | 58/23 BA |

*Primary Examiner*—Edith Simmons Jackmon

*Attorney, Agent, or Firm*—Weiser, Stapler & Spivak

[57] ABSTRACT

In electronic watch-and-band arrangements the batteries are located in the band portion, separately from the watch movement and display. This permits the arrangement to assume novel configuration and gives it novel disposable features.

9 Claims, 4 Drawing Figures

DISTRIBUTED WATCH

This invention relates to improvements in so-called electronic watches. Such watches are characterized by the absence of the usual mechanical watch movement, for which there is substituted electronic timing and control circuitry, and also by the absence of the usual watch indicator hands for which there is substituted an electronic display such as a liquid crystal display (LCD) or light emitting diodes (LED). Electronic watches have a problem of packaging, particularly with respect to the interaction between packaging and the batteries which provide the electrical energy for operating these watches.

Heretofore, the entire electronic watch itself has been treated as a single physical unit, containing not only the above-mentioned electronic circuitry and display but also the one battery, or, in the case of LED watches, the two batteries customarily required. All of these elements were enclosed in a watch casing closely resembling that of traditional mechanical watches. This watch casing was provided with means for attaching it in conventional manner to conventional types of watch bands.

Such a construction is consistent with attempts to preserve as much of conventional watch technology as possible, in the course of making the transition to electronic watches. However, it leaves much to be desired from other standpoints.

Specifically, the battery, or batteries required by the electronic watch represent one of its bulkiest components, and their inclusion within the watch casing itself therefore inherently forces upon that casing a bulk sufficient to accommodate their presence. This, in turn, greatly restricts the opportunity for taking advantage of other characteristics of electronic watches, both with respect to styling and with respect to utilitarian considerations.

Accordingly, it is an object of this invention to provide electronic watch arrangements which are not subject to the disadvantages noted above.

These and other objects which will appear, are achieved in accordance with the invention by removing the battery, or batteries from their traditional position within the casing of an electronic watch and placing them instead within what would traditionally have been considered as the watch band.

For further details, reference is made to the description which follows, in the light of the accompanying drawings wherein FIG. 1 shows a watch-and-watch-band arrangement embodying the present invention viewed from the face side of the watch;

The same reference numerals are used in the various figures to designate similar elements.

Figure 1:
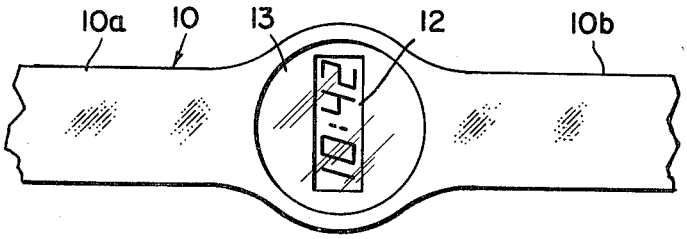
Figure 2:
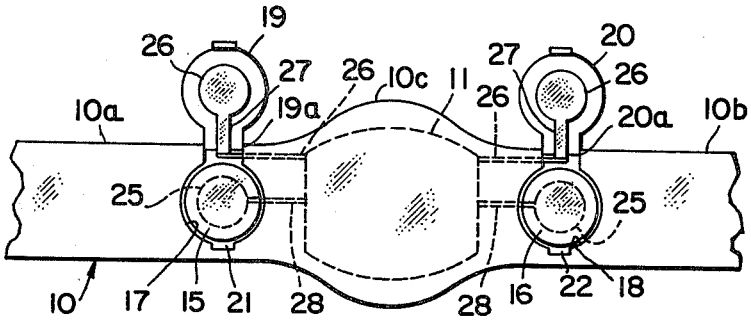
FIG. 2 shows the embodiment of FIG. 1 viewed from the reverse side.

FIGS. 1 and 2, to which reference may now be had, show a watch-and-band arrangement 10, within which provisions are made for retaining a watch movement 11, outlined in broken lines in FIG. 2. The arrangement comprises a display 12 visible in FIG. 1 through glass face 13. Unlike in a traditional watch and watch band arrangement, in the embodiment of FIGS. 1 and 2 according to the invention the electronic movement 11 is more or less permanently embedded in the watch-and-band arrangement 10, which is preferably formed as an integral piece including not only the end portions 10*a* and 10*b* which surround the arm of the wearer, but also the enlarged portion 10*c* containing the watch movement 11, the electronic display 12, and glass face 13. Preferably, this integral piece is made of a suitable flexible plastic material, such as polypropylene, which lends itself to ready fabrication in virtually any configuration. More specifically, the watch-and-band assembly 10 may be made in two halves, consisting respectively of the half to be worn closest to the arm and visible in FIG. 2, and the half farthest from the arm and visible in FIG. 1. After incorporation in these halves of all of the various components, they are joined in conventional manner, such as by gluing or fusing at their edges. The usual band closures, such as buckles or the like may be provided at opposite ends of band portions 10*a* and 10*b*. These closures may take any conventional form and are therefore not further discussed in this application.

Movement 11 may also take any desired form. It will include the typical components of an electronic watch movement, such as a frequency determining crystal, microcircuits for performing the various electronic circuit functions, an inductor for stepping up the voltage for driving the display, if necessary, and so forth.

The batteries which provide electric power for the operation of the watch are located, not in immediate association with movement 11 as has been customary, but rather physically quite separate from that movement, as shown particularly in FIG. 2. In that figure, there are two batteries 15 and 16 of the usual button type, positioned within recesses 17 and 18 provided within band portions 10*a* and 10*b*, respectively. These recesses are provided with lids 19 and 20, respectively, the lids being attached to their respective recesses by flexible hinges formed of plastic tabs 19*a* and 20*a*. Conventional snap latches 21 and 22 are provided for the lids when these are brought down to close the recesses with which they are associated. In the bottom of each recess, there is an electrical contact 25. On the underside of the lid which closes this recess, i.e. on the side which comes into contact with the button battery when the lid is closed there is another contact 26. From each contact 26, a lead 27 extends along the underside of the respective lid and on into the interior of the band (where it is shown in broken lines) until it ultimately enters electronic movement 11. Likewise, from each electrical contact 25, there extends a lead 28 through the interior of band 10 until it also enters electronic movement 11. These leads 27 and 28 conduct electricity from the respective batteries into the watch movement for operation of the latter and of the display 12 in conventional manner. In FIG. 2, the watch is shown with lids 19 and 20 in their open position. This is the position which permits replacement of batteries 15 and 16. Such replacement is accomplished by simply lifting the batteries out of their recesses and placing replacement batteries therein. Lids 19 and 20 are then brought down and snapped shut; in the process completing the electrical circuit connections to watch movement 11. Thus, in accordance with the invention, battery replacement is made exceptionally convenient. In addition, this arrangement permits reduction in overall size of the enlarged portion 10*c* of the watch-and-band arrangement by eliminating the batteries from that portion.

Figure 3:
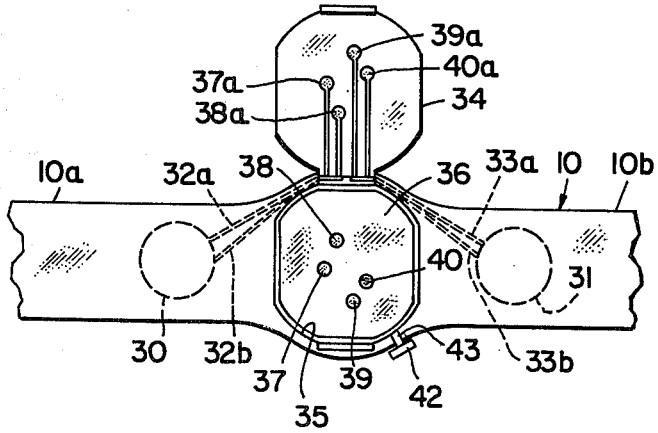
FIG. 3 shows another embodiment of the invention also viewed from the reverse of the watch face side.

Referring to FIG. 3, this shows an embodiment in which the batteries are permanently embedded in the arm band portions 10*a* and 10*b*. These batteries are shown in broken lines at 30 and 31 in FIG. 3. From each battery there extend two electrical connectors, 32*a*, 32*b*, and 33*a*, 33*b*, respectively, which are located within the interior of the watch band 10 until they emerge on the lower surface of a lid 34 capable of covering an aperture 35 provided in the enlarged center portion 10*c* of watch-and-band arrangement 10. This aperture 35 receives the electronic movement 36 and the display (not visible in the rear view of FIG. 3). On the back of movement 33 there are exposed electrical terminals 37 through 40. These are positioned so that they mate, respectively, with electrical terminals 37*a* through 40*a* on the underside of lid 34. The latter terminals 37*a* through 40*a* form the ends of leads 32*a*, 32*b*, 33*a*, and 33*b*, respectively. Lid 34 is hinged to opening 35 by a conventional plastic hinge. A snap closure 41 of conventional design is provided for holding that lid closed when it is brought down onto recess 35. When snapped shut, lid 34 brings contacts 37*a* through 40*a* to bear against contacts 37 through 40 on the back of the watch movement, thereby establishing electrical contact between batteries 30, 31 and the internal components of the watch movement.

In the embodiment of FIG. 3, replacements of batteries is accomplished by opening lid 34, removing the entire watch movement 36 and its display, and inserting same into a new band 10 already containing the replacement batteries. Lid 34 of this new band is then closed, and the watch is ready to operate with replacement batteries. Thus, in the embodiment of FIG. 3, the watch band and batteries are essentially disposable items. This is consistent with the fact that the watch band itself can be of inexpensive plastic construction, whereas the batteries, which would have to be disposed of in any case, represent a more costly ingredient and the movement and associated display device, which are used over and over, represent the items of highest cost.

A regulating stem 42 is shown as part of the movement in FIG. 3. A channel 43 can be provided in the edge of recess 35 to accommodate this stem. This also aids in orienting the movement azimuthally within recess 35. For the same purpose, the sides of the recess 35 may be shaped with flattened portions to conform to flattened sides on the movement.

Figure 4:
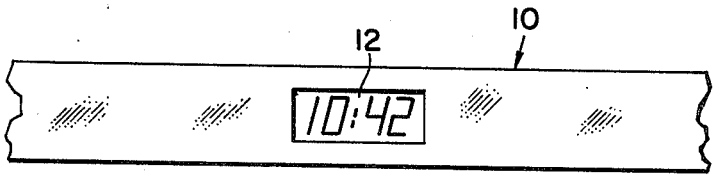
FIG. 4 shows still another embodiment viewed from the watch face side.

The further embodiment of FIG. 4, to which reference may now be had, dramatizes the improvement in electronic watch construction which is made possible by the present invention. In this embodiment, watch-and-band arrangement 10 is of uniform width throughout, that width being no greater than the width of the band alone in traditional watch-and-band combinations of both mechanical and electronic type. The electronic display 12 is embedded within this band in such a way that the direction in which its numerals follow one another parallels the edge of the band. This direction is perpendicular to that in which the electronic display is traditionally positioned in electronic watches (see also FIG. 1).

The positioning of FIG. 4 is made possible by placing the batteries within the watch band in a manner such as shown in FIG. 2. As a result of this battery placement, in accordance with the present invention, the bulk of the casing enclosing the movement and display is reduced, and that movement can be given a configuration conforming essentially to the aspect ratio of electronic display 12.

With respect to all of the embodiments of the invention, it will be understood that the electronic movement itself does not inherently demand any particular physical configuration, and can therefore be readily arranged by one skilled in the art in the configurations of FIGS. 1 through 4.

It will be further understood that various other embodiments will occur to those skilled in the art without departing from the inventive concept.

I claim:

1. An electronic wristwatch-and-band arrangement comprising a casing enclosing an electronic wrist watch movement and display, but not the electronic power source therefor, a band formed of a longitudinally continuous, flexible member extending substantially from one end of the band to the other, at least two recesses in said band, one recess being adapted to receive the casing and the other being adapted to receive a battery for powering the electronic watch, the casing recess being so constructed and arranged that the casing inserted therein has its rim surrounded by the band, leaving only the watch face exposed from one side of the band, and one of said recesses having an openable lid in the opposite side of the band through which the recess contents can be replaced.

2. The arrangement of claim 1 wherein the other recess has no operable lid in either side of the band.

3. The arrangement of claim 1 comprising two battery recesses, respectively positioned longitudinally displaced on opposite sides of the casing recess.

4. The arrangement of claim 1 wherein the casing recess has the lid, and the battery recess does not have a lid, whereby the band and battery become an integral, replaceable unit.

5. The arrangement of claim 1 wherein the casing recess has a notch in its periphery, through which a stem of the movement protrudes, and which also serves to position the casing azimuthally in the recess.

6. The arrangement of claim 1 wherein the casing has a rectangular aspect ratio conforming substantially to the aspect ratio of the electronic display, and the casing recess is shaped to receive the casing with the longitudinal axis of the casing positioned lengthwise of the band.

7. The arrangement of claim 6 wherein the band portion defining the casing recess is not substantially wider than the short dimension of the rectangular casing.

8. The arrangement of claim 7 wherein the band portion defining the casing recess is narrower than the long dimension of the rectangular casing.

9. The arrangement of claim 8 wherein the band is of substantially uniform width throughout its length.

* * * * *